US006655677B2

(12) United States Patent
Marshall et al.

(10) Patent No.: US 6,655,677 B2
(45) Date of Patent: Dec. 2, 2003

(54) ACTIVE GAP CONTROLLED FEEDER

(75) Inventors: Gary R. Marshall, Waterloo (CA); Alexander S. Murison, Waterloo (CA); George J. Hroch, Kitchener (CA); Armand M. Dumas, Waterloo (CA)

(73) Assignee: NCR Corporation, Dayton, OH (US)

( * ) Notice: Subject to any disclaimer, the term of this patent is extended or adjusted under 35 U.S.C. 154(b) by 35 days.

(21) Appl. No.: 09/871,933

(22) Filed: Jun. 1, 2001

(65) Prior Publication Data

US 2002/0180138 A1 Dec. 5, 2002

(51) Int. Cl.[7] ..... B65H 5/00
(52) U.S. Cl. ..... 271/10.03; 271/10.02
(58) Field of Search ..... 271/10.03, 10.02, 271/10.01, 270

(56) References Cited

U.S. PATENT DOCUMENTS 4,331,328 A * 5/1982 Fasig ..... 271/270
5,120,977 A * 6/1992 Dragon et al. ..... 250/559.37
5,358,464 A * 10/1994 Funk et al. ..... 493/320
5,423,527 A * 6/1995 Tranquilla ..... 271/10.02
5,848,784 A * 12/1998 Tranquilla ..... 271/10.03
5,926,392 A * 7/1999 York et al. ..... 700/223
6,089,561 A 7/2000 Marshall et al.

* cited by examiner

*Primary Examiner*—Donald P. Walsh
*Assistant Examiner*—Joseph Rodriguez
(74) *Attorney, Agent, or Firm*—Francis L. Conte, Esq.

(57) ABSTRACT

A document feeder includes advance, separation, and transport rollers for driving checks in turn along a feedpath from an input tray containing a stack of the checks A sensor is disposed between the separation and transport rollers for detecting presence of the checks therebetween. A controller is joined to the rollers for controlling speed thereof, and is operatively joined to the sensor for measuring intercheck gaps between the separation and transport rollers. The controller actively adjusts the intercheck gaps by temporarily changing speed of the separation roller at the beginning of the feedpath near the input tray. The intercheck gaps are measured and corrected between the separation and transport rollers for precise control thereof while maximizing throughput.

12 Claims, 4 Drawing Sheets

RUN TRANSPORT SPEED
TIME STAMP T. E.
TIME STAMP L. E.
DETERMINE GAP LENGTH
CALCULATE CORRECTION HALT
HALT SEPARATION ROLLER
RESUME TRANSPORT SPEED
TIME
TIME
30
48b
44
12a
20
42
48
34
36
M
52B
54
12b
18
32
50B
G

ACTIVE GAP CONTROLLED FEEDER

BACKGROUND OF THE INVENTION

The present invention relates generally to document feeders, and, more specifically, to document feeders in commercial high speed document processing equipment.

Document feeders are common in various types of equipment in which a stack of documents or sheets of paper are to be processed one-by-one in sequence. Common sheet feeders are found in copying machines and fax machines which typically operate at relatively low sheet feeding speeds.

As the feeding speed increases, the document feeders configured therefor typically increase in complexity and cost in view of the increased difficulty associated therewith. For example, banking institutions or other processing centers use sophisticated check processing machines for reading, imaging, encoding, and sorting commercial checks at considerable speed. Four hundred checks or documents per minute (400 dpm) carried through the processing machine is a relatively high rate which is typically maintained continuous for one or more business operating shifts per day.

The checks are loaded in stacks into a hopper portion of the machine which individually transports the checks in turn through the remainder of the machine along a check feedpath defined by driven rollers and belts and associated guiding elements. A controller in the form of a digitally programmable computer controls the entire operation of the machine including the speed of the various motors driving the various transport rollers and belts for maximizing check processing throughput, without unacceptable jamming of the checks or other malfunctions in any one of the modules of the machine.

Optical sensors are disposed along the entire check feedpath through the machine for detecting the presence of the checks and the motion thereof for use in controlling operation and detecting any jamming which may occur. Malfunction or jamming must be instantaneously detected by the sensors for correspondingly interrupting operation of the driving motors to limit the adverse affects thereof.

Any interruption in normal operation of the check processing machine correspondingly reduces its effective check processing throughput, and is commercially undesirable as a loss of valuable processing time with a corresponding increase in associated costs.

Maximum throughput of the series of checks transported through the machine is limited in practice by a minimum desirable spacing or gap between the traveling checks. For example, the encoding module of the machine must have sufficient time to print along the bottom edge of the check a suitable code indicative of the check processing or clearing operation.

Correspondingly, the desired processing throughput rate controls the maximum gap between traveling checks since the checks may be more widely spaced apart at slower transport speeds if desired.

Nevertheless, it is common practice to use the optical sensors in the machine for determining intercheck gaps during operation and adjust those gaps as desired. Since relatively large gaps provide sufficient time for processing each check in each of the various modules of the machine, the control thereof does not require either high precision or fast response. For example, one check processing machine enjoying years of successful commercial use in this country is designed for a throughput rate of about 400 checks per minute for continuous operation of the machine without malfunction or jamming due to excessively small intercheck gaps.

Commercial checks vary in length from about 4.8–9 inches (12.2–22.9 cm) in length and about 2.75–5 inches (7–12.7 cm) in width or vertical height. With a nominal check length of about 6 inches (15.2 cm) a nominal intercheck gap of about 9 inches (22.9 cm) will occur at the 400 dpm throughput rate. This relatively large gap may be effectively measured by optical sensors placed several checks downstream in the feedpath from the inlet hopper tray. Measurement of the size of the downstream gaps may be used to adjust gap size upstream therefrom, typically by intermittently halting operation of the advance drive motor for correspondingly increasing intercheck gaps as desired.

However, in a higher speed check processing machine being developed, the nominal intercheck gap is closer to the minimum permitted value for the machine which can therefore randomly result in occasional intercheck gaps less than the permitted minimum. When sub-minimum gaps occur, downstream monitoring sensors can lead to operational warnings or automatic interruption in the check processing machine requiring remedial correction. And, sub-minimum gaps may also cause undesirable jamming of the checks which also requires remedial operator intervention which substantially reduces the overall throughput rate of the machine during use.

Accordingly, it is desired to provide an improved document feeder and method of operation for actively controlling interdocument gaps.

BRIEF SUMMARY OF THE INVENTION

A document feeder includes advance, separation, and transport rollers for driving documents in turn along a feedpath from an input tray containing a stack of the documents. A sensor is disposed between the separation and transport rollers for detecting presence of the documents therebetween. A controller is joined to the rollers for controlling speed thereof, and is operatively joined to the sensor for measuring interdocument gaps between the separation and transport rollers. The controller actively adjusts the interdocument gaps by temporarily changing speed of the separation roller at the beginning of the feedpath near the input tray. The interdocument gaps are measured and corrected between the separation and transport rollers for precise control thereof while maximizing throughput.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
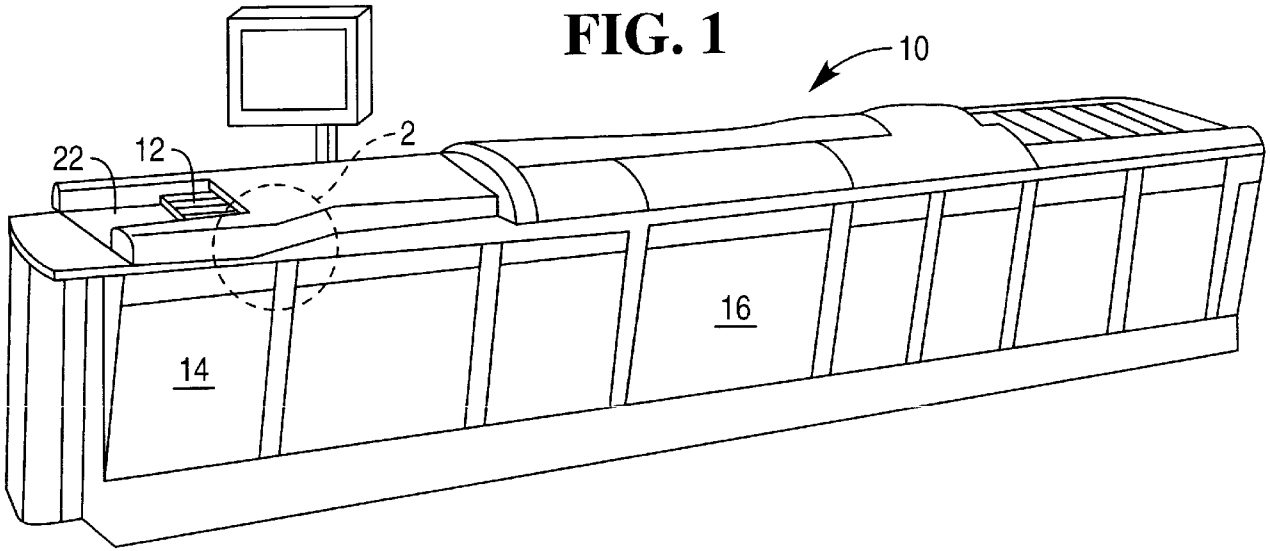
FIG. 1 is an isometric view of an exemplary check processing machine having a document feeder in accordance with an exemplary embodiment of the present invention.

Illustrated in FIG. 1 is an apparatus or processor 10 for processing at high speed a stack of documents 12 in the exemplary form of conventional commercial checks being processed or cleared by a typical banking institution or processing center. The check processor includes various modules suitably joined together in a row, including at one end a document feeder 14 followed in turn by modules for reading, imaging, encoding, endorsing, verifying, and sorting the checks in a conventional manner.

The individual checks 12 are transported through the various modules at a relatively high rate of speed for maximizing the throughput processing rate thereof for substantially continuous operation in working shifts. Maximum throughput is typically limited by the minimum allowable interdocument or intercheck gaps between the checks as they are transported through the machine.

For example, the processor includes a check encoder 16 as one of the intermediate modules which is conventionally configured for printing a processing code along the bottom of each check being processed. The encoder is typically the one module which sets the minimum intercheck gap acceptable for continuous operation of the machine without premature malfunction warnings or undesirable check jamming. Accordingly, the speed and throughput rate of the individual checks may only be maximized provided that the intercheck gap does not decrease below the specified minimum.

Figure 2:
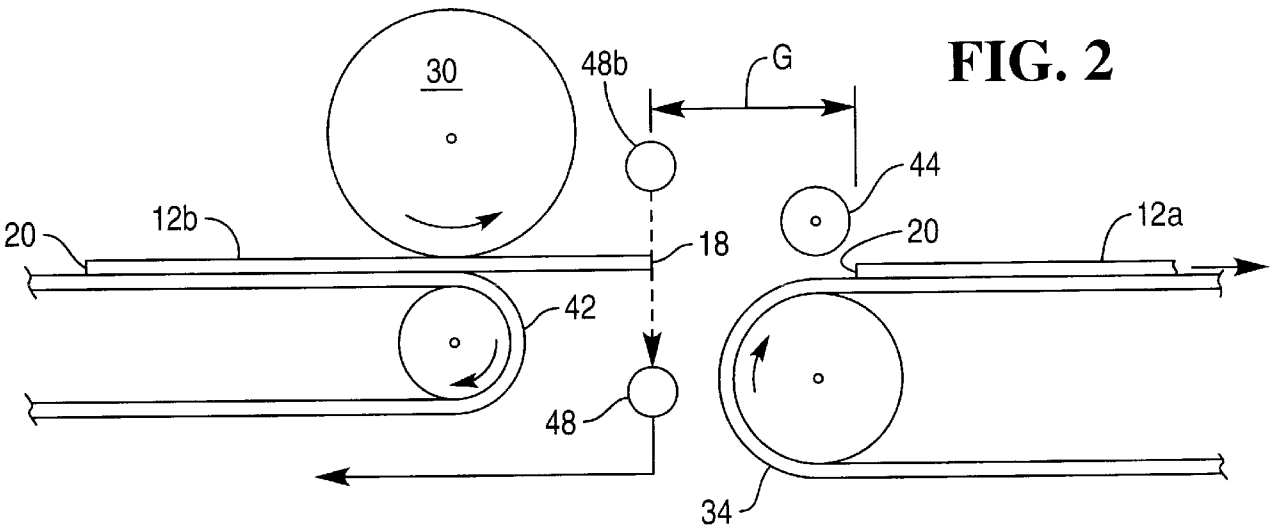
FIG. 2 is an enlarged schematic view of respective portions of adjoining separation and transport rollers found within the dashed circle labeled 2 in FIG. 1, between which intercheck gaps are measured and corrected in accordance with an exemplary embodiment of the present invention.

A portion of the document feeder is illustrated schematically in FIG. 2 in which a first one of the documents or checks designated 12*a* is being transported in sequence ahead of a following second document or check designated 12*b*, with succeeding checks being transported in sequence one-by-one. In this way, any two checks being transported in turn through the processor include a leading check 12*a* followed directly behind by a trailing check 12*b*.

And, each check includes a leading edge 18 traveling first through the processor followed in turn by a longitudinally opposite trailing edge 20. An interdocument or intercheck gap G is thusly defined by the spacing between the trailing edge 20 of the first check 12*a* and the leading edge 18 of the following second check 12*b*.

Figure 3:
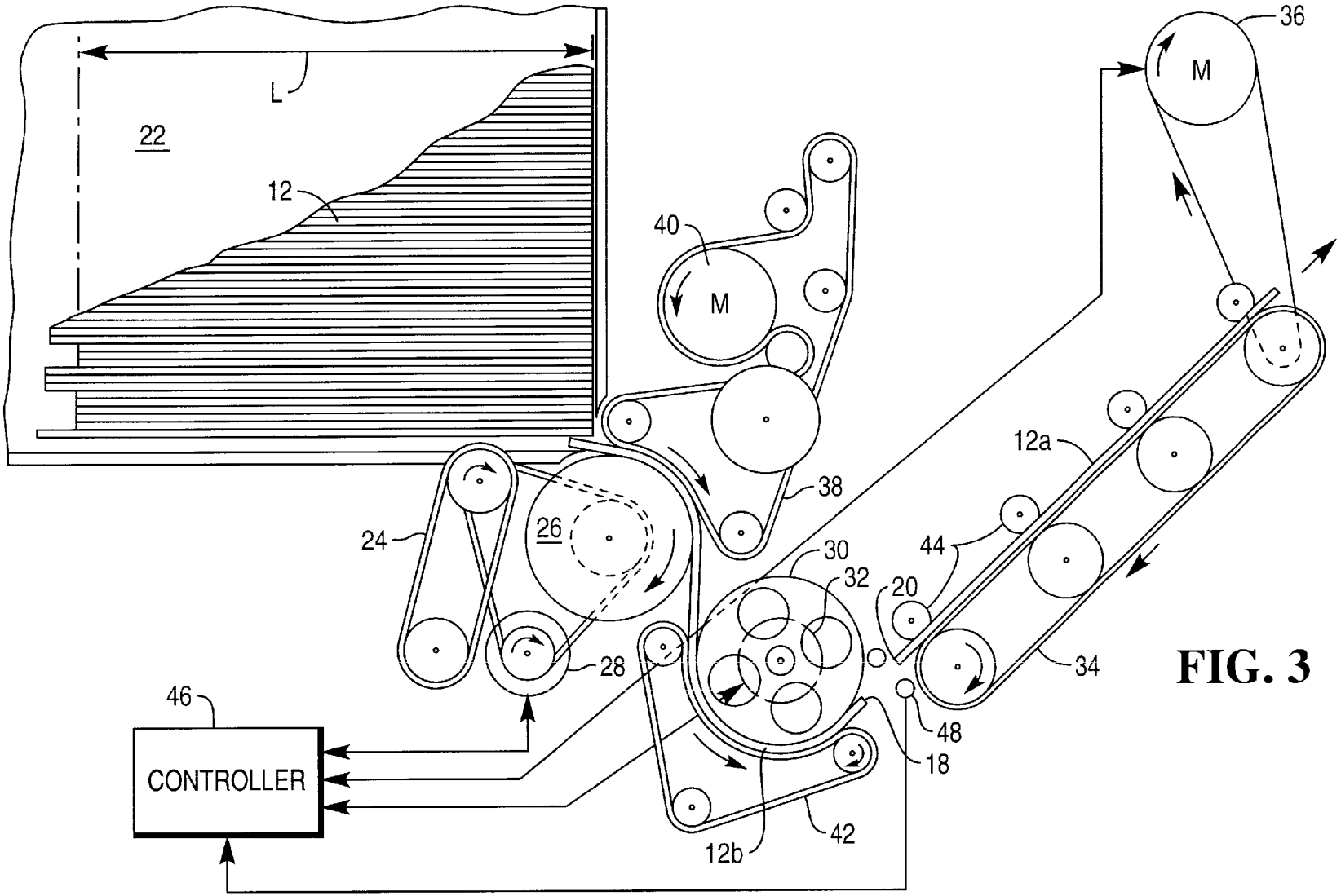
FIG. 3 is a schematic top view of a portion of the document feeder illustrated in FIG. 1 including an exemplary feedpath therethrough.

FIG. 3 illustrates schematically an exemplary embodiment of the major components of the transport mechanism for the document feeder 14 illustrated in FIG. 1, which corresponds in part with the portion thereof illustrated in FIG. 2. The document feeder 14 is also referred to as a hopper since it includes an input hopper or tray 22 in which a stack of the checks 12 is placed for processing in a vertically standing position as shown in top view in FIG. 3. The checks may have any conventional configuration, and are typically thin sheets of paper which vary in length L and width or height as indicated above.

The feeder includes a picker 24 in the exemplary form of a driven urethane belt for frictionally engaging each of the checks in turn for driving them through a feedpath commencing at the input tray 22 and terminating at the opposite end of the machine illustrated in FIG. 1 at any one of several output trays used for sorting the checks. The feedpath is defined by cooperating transport rollers or belts and guide rails specifically configured for the precision transport of the individual checks through the processor.

In the preferred embodiment illustrated in FIG. 3, an advance roller 26 adjoins the input tray 22 for first driving the checks sequentially in turn along the feedpath as they are delivered thereto by the picker 24. The advance roller is preferably in the form of a silicone wheel surrounding a central hub which is driven by a timing belt from a corresponding first drive motor 28. The drive motor is preferably a stepper motor which precisely drives both the advance roller 26 and the picker belt 24 through the common timing belt.

A separation roller 30 adjoins the advance roller downstream therefrom for further driving the checks in turn along the common feedpath from the advance roller. The separation roller 30 is in the exemplary form of a conventional aluminum drum having a textured drive surface directly driven by a second drive motor 32 suitably joined thereto. The second drive motor is preferably also a stepper motor for precisely controlling movement of the separation roller 30.

A transport roller 34 is spaced downstream from the separation roller 30 along the common feedpath for further driving the checks downstream therefrom. The transport roller is in the preferred form of a neoprene belt suitably supported on guide wheels and suitably driven by a third stepper drive motor 36 operatively joined thereto by another timing belt.

Cooperating with the advance roller 26 is a retard roller 38 in the exemplary form of a urethane foam belt suitably mounted on supporting wheels in a conventional manner for adjusting the tension thereof. The retard roller 38 is driven by a fourth drive motor 40 with a cooperating reduction gearbox for driving the retard roller at a substantially lower speed than that of the advance roller 26 in a conventional manner for retarding feeding of more than one check at a time from the input tray 22. The advance roller 26 and retard roller 38 cooperate with each other on opposite sides of the feedpath for initially receiving a single check at a time into the feedpath.

The separation roller 30 cooperates with an idler roller 42 in the exemplary form of a urethane belt suitably mounted on guide wheels on opposite sides of the feedpath. The idler belt 42 presses and holds checks against the driven separation roller 30 during operation. And, the transport roller 34 cooperates with corresponding spring loaded idler rollers 44 disposed on opposite sides of the feedpath corresponding with the guide wheels supporting the belt roller 34.

An electrical controller 46 in the exemplary form of a digitally programmable computer is operatively joined to the advance, separation, and transport rollers through their corresponding stepper motors 28,32, and 36 which control their rotary operation. In this way, the speed of the individual stepper motors may be accurately controlled by the controller for in turn controlling transport speed of the individual checks along the feedpath.

In basic operation, the corresponding stepper motors for the advance, separation, and transport rollers 26,30,34 are driven to obtain the desired throughput rate for transporting the individual checks in sequence through the check processing machine. The separation and transport rollers 30,34 preferably both run at the same transport speed which is maximized to maximize the throughput rate. The advance roller 26 is run at a suitable fraction of the speed of the separation roller 30 to generate separation or the interdocument gaps between successive checks. The first stepper motor 28 preferably has variable speed control effected by the controller to adjust the intercheck gap at its creation.

The controller 46 is thusly configured to operate the separation roller 30 at a speed suitably greater than that of the advance roller 26 to effect a natural intercheck gap between successive checks carried from the advance roller to the separation roller, and in turn downstream to the transport roller.

The retard roller 38 is operated slower than the advance roller 26 to ensure feeding of one check at a time from the input tray into the feedpath. In this way, the natural intercheck gap is created as each check leaves the slower moving advance roller 26 and is driven downstream by the faster moving separation roller.

As shown in FIG. 2, the separation roller creates the intercheck gaps which vary in size according to the length of the individual checks. Since longer checks remain longer under the control of the slower advance roller, the gap behind the leading check under control of the faster moving separation roller 30 increases. Correspondingly, shorter checks remain under control of the slower advance roller for a shorter time leading to a smaller gap with the downstream leading check being driven by the higher speed of the separation roller.

The document feeder as described above is conventional in configuration and operation and works effectively without unacceptably small intercheck gaps up to a limited high throughput rate of about 400 dpm as indicated above. For a nominal check length of about 6 inches (15.2 cm) the nominal intercheck gap G is about 9 inches (22.9 cm) which is more than adequate for proper operation of all the modules of the check processor.

Any variation in that nominal gap due to variations in check length or to variations in the friction driving from the various rollers in the feedpath do not significantly change the large intercheck gap. Intercheck control of such a large gap may therefore be effected in any conventional manner including control of the relative speeds of the advance and separation rollers by gap detection several checks downstream in the feedpath past the transport roller.

However, and as indicated above, further increases in document throughput rate correspondingly result in a reduction of the nominal intercheck gap which may then become closer to the permissible minimum gap for proper operation without malfunction or jamming, and the intercheck gap control becomes more critical.

For example, by increasing the throughput rate to 600 dpm a nominal intercheck gap of about 4 inches (10.2 cm) for the same nominal check length results which is relatively close to the minimum permitted intercheck gap. Variation in check length in addition to variation in the friction driving capability of the driven rollers randomly affects the actual intercheck gap which may occasionally fall below the permitted minimum.

In such an event, the sub-minimum gaps will be detected by optical sensors in the downstream modules of the check processor leading to an operator warning or alert, and possibly shutdown of the check processor for corrective action. The sub-minimum intercheck gap may also cause undesirable jamming of checks during the high speed transport thereof also requiring operator intervention and correction.

In accordance with the present invention as initially illustrated in FIG. 2, a proximity sensor 48 in the preferred form of an optical sensor is fixedly mounted in the check feedpath between the separation and transport rollers 30,34 for detecting presence, or lack thereof, of each of the checks as they are transported therebetween. The optical sensor 48 may be identical to those optical sensors conventionally located along the entire feedpath of the check processor, and includes a phototransistor on one side of the feedpath cooperating with a light emitter 48*b* in the exemplary form of a light emitting diode on the opposite side of the feedpath.

As the checks are transported past the optical sensor 48, the light beam is periodically interrupted by the passing checks indicating the presence thereof. The intercheck gaps do not interrupt the light beam and are thusly correspondingly detected.

The single optical sensor 48 placed between the separation and transport rollers provides a manner for directly measuring the intercheck gap at the beginning of the high speed transport feedpath to control the size thereof and prevent sub-minimum gaps from traveling downstream through the processor modules, including the encoder module 16 with its corresponding minimum intercheck gap requirement.

As illustrated in FIG. 3, the optical sensor 48 is operatively joined to the controller 46 which is configured in accordance with the present invention for measuring the intercheck gaps G on the fly between the separation and transport rollers. The controller 46 is also configured for correspondingly actively adjusting the intercheck gaps by temporarily changing speed of the separation roller 30 as required based on the measured value of the specific intercheck gap. In this way, active gap correction is immediately effected at the beginning of the transport portion of the feedpath for precisely controlling intercheck gaps downstream therefrom irrespective of variation in check length or frictional characteristics of the advance and separation rollers 26,30 initially forming the intercheck gaps.

Since the controller 46 is preferably in the form of a digitally programmable computer, it may be conventionally programmed in suitable software for measuring the magnitude of the intercheck gaps using the optical sensor 48, and then calculating the necessary correction in the measured gap which is immediately implemented by temporarily adjusting the speed of the separation roller 30 while the corresponding trailing check 12*b* is within the control thereof. Simultaneously, the speed of the advance roller 26 is also temporarily adjusted to maintain constant the speed fraction with the separation roller 30.

For example, if the gap between the leading check 12*a* and the trailing check 12*b* is too small, the trailing check 12*b* may be temporarily retarded for increasing the gap at its leading edge 18 to meet the desired gap requirement. If the gap is initially too large, the trailing check 12*b* may be temporarily accelerated in speed to reduce the gap at its leading edge 18 to the desired gap requirement. After each gap correction, the speed of the separation roller 30 is returned immediately to its nominal transport speed for maximizing the throughput rate of the checks in the preferred embodiment. In this way, active gap control occurs check-by-check at the commencement of the transport feedpath.

Accordingly, by the simple introduction of the optical sensor 48 and associated changes in the controller 46, active gap correction may be effected in a relatively simple manner for accommodating the different intercheck gaps created by variation in check length and variation in roller frictional materials. The optical sensor 48 is used for measuring the actual intercheck gaps between the separation and transport rollers 30,34, and then the controller 46 is used for temporarily changing speed of the separation roller 30 by precisely controlling its driving stepper motor 32 for actively adjusting the size of the actual gap measured by the sensor.

Figure 4:
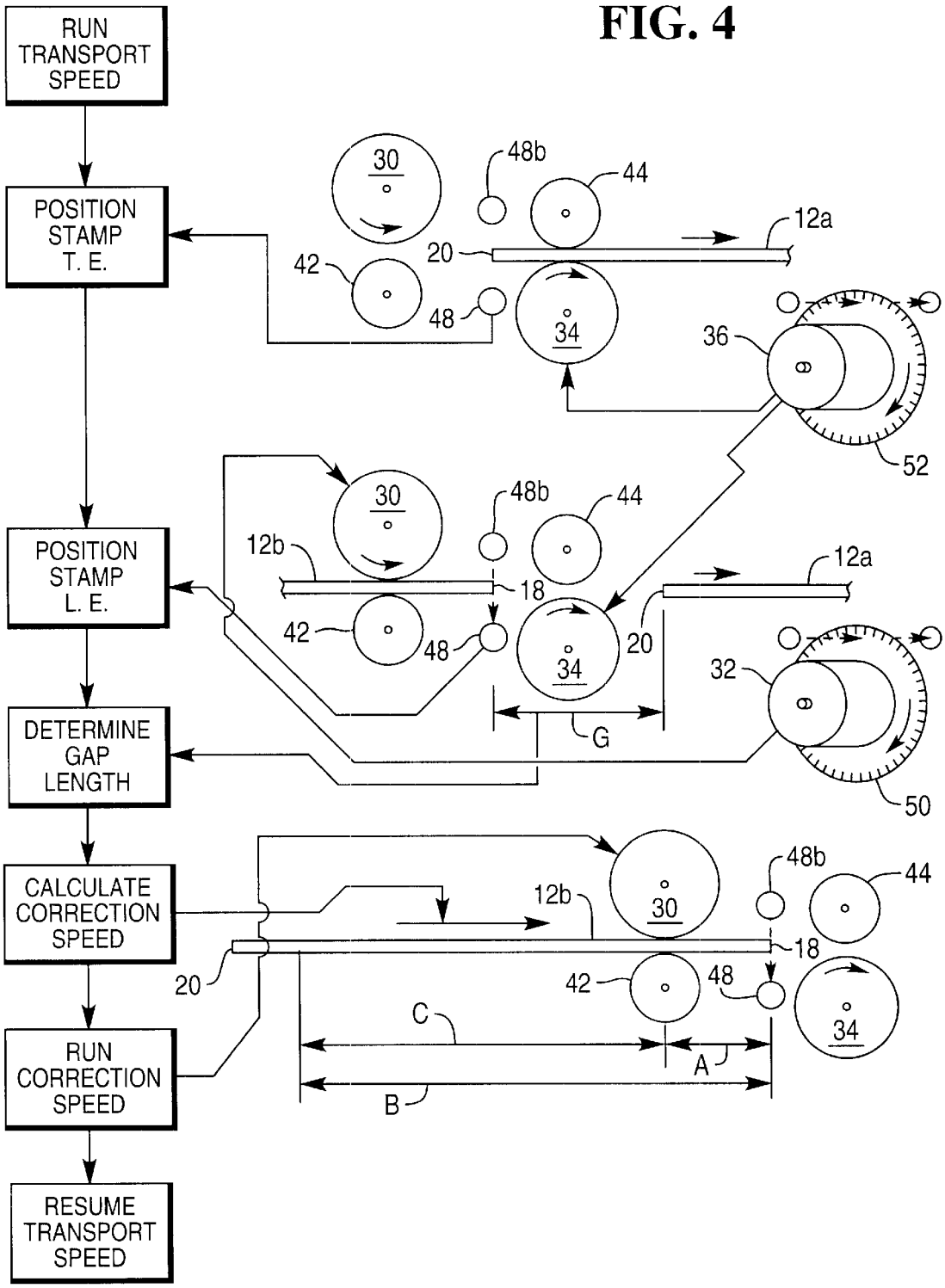
FIG. 4 is a flowchart representation of an exemplary method of operating the document feeder illustrated in FIG. 3 in accordance with one embodiment of the present invention.

FIG. 4 illustrates in flowchart form an exemplary method of operating the document feeder illustrated schematically in FIG. 3. Cooperating with the separation roller 30 is a first rotary encoder 50 for measuring rotary speed thereof, as well as position in a preferred embodiment. The rotary encoder may have any conventional configuration and may be suitably joined to the separation roller 30 in various manners. For example, the encoder may be attached to the drive shaft of the stepper motor 32 which in turn drives the separation roller 30.

The rotary encoder typically includes a disk having a multitude of slits around the perimeter thereof which cooperate with a conventional optical sensor in the form of a light emitter and detector bridging the disk whose light beam is interrupted by the rotating encoder disk. In this way, the circumferential position of the disk and the drive shaft may be readily determined along with the rotary speed thereof in a conventional manner. Since the stepper motor 32 drives the separation roller 30, the rotary encoder 50 may also be used for determining the rotary position of the roller itself and, in particular, the longitudinal position of the checks being transported thereby.

Correspondingly, a second rotary encoder 52 cooperates with the transport roller 34 in a manner substantially identical with that of the first encoder and the separation roller for measuring rotary position of the transport roller 34 by rotary position of its drive motor 36, for in turn measuring the longitudinal position of the checks being driven by the transport roller.

The two encoders 50,52 are preferably identical in configuration and encoding accuracy and are both operatively joined to the controller 46 illustrated in FIG. 3 for use in precisely controlling the transport speeds of both separation and transport rollers 30,34 during operation. The controller 46 is further configured to measure or calculate the intercheck gap G between the trailing edge 20 of the first or leading check 12*a* passing the sensor 48, and the leading edge 18 of the second or trailing check 12*b* which passes the sensor 48 immediately behind the leading check.

One manner of measuring the intercheck gap G using the single sensor 48 is by also measuring corresponding difference in position of the trailing edge of the first check as indicated by the second encoder 52.

Preferably the first and second encoders 50,52 are high resolution encoders effective for accurately measuring both rotational position and rotary speed. Each encoder may include, for example, 1,000 slits around the disk circumference cooperating with a pair of optical sensors in quadrature for providing corresponding 4,000 count resolution for each revolution. In this way, the rotary position of the second encoder 52 may be used for determining the precise position of the first check 12*a* being carried by the transport roller 34 with sufficient precision for the desired 600 dpm rate of travel of the checks along the feedpath.

The preferred method of operation of the check feeder is to initially operate the various rollers including the transport roller 34 at the desired transport speed preferably corresponding with the maximum feedrate of about 600 dpm for example. In this way, the nominal intercheck gap will be about 4 inches (10.2 cm) for the nominal 6 inch (15.2 cm) check length.

As the first check 12*a* is being transferred from the separation roller 30 to the transport roller 34, the light beam to the optical sensor 48 is interrupted until the trailing edge 20 travels downstream past the sensor. In this way, the trailing edge of the first document may be readily detected by the sensor 48, at which time the controller is used for position stamping the second encoder 52 for indicating the corresponding rotary position of the encoder disk thereof corresponding with detection of the trailing edge of the first document. This position stamp location is suitably stored in memory associated with the controller.

As the first check continues its downstream travel, the next following second check 12*b* is carried by the separation roller 30 toward the sensor 48. The sensor may then detect the leading edge 18 of the second check 12*b* as the light beam to the sensor is interrupted, and the second encoder 52 is again position stamped for determining the corresponding position of the trailing edge of the first check being driven by the transport roller 34 which corresponds with detection of the leading edge of the second check.

By calculating in the controller the positional difference between the position stamped trailing and leading edges of the successive checks 12*a,b* the corresponding gap G may be determined. The intercheck gap G is simply the difference in longitudinal position of the trailing edge 20 of the first check 12*a* as it is driven by the transport roller 34 during the time interval between detection of its trailing edge 20 and detection of the following leading edge 18 of the second check 12*b*.

Once the size of the intercheck gap G is determined, any required correction thereof may be effected. For example, if the gap G is too small, the separation roller 30 may be retarded for increasing the gap as the first check continues to move downstream. If the measured gap G is too large, the separation roller 30 may be accelerated to decrease the gap as the second check is driven closer to the preceding first check.

Accordingly, by temporarily changing speed of the separation roller 30 in response to the measured gap, the intercheck gap may be actively adjusted as both the first and second checks 12*a,b* are independently driven by their respective transport and separation rollers 34,30.

In the preferred embodiment it is desired to operate the document feeder at maximum throughput rate near the minimum desired intercheck gap for the checks of maximum length. Shorter checks will then effect a correspondingly smaller intercheck gap which may be actively increased check-by-check as required by temporarily reducing the speed of the separation roller 30 to correspondingly increase the intercheck gap as the second check 12*b* is driven by the separation roller.

The desired amount of intercheck gap change is simply the difference between the measured gap and the desired gap which is preferably slightly greater than the minimum gap design requirement. And, the active gap correction may be effected by increasing speed of the separation roller for decreasing gaps, or decreasing speed of the separation roller for increasing gaps relative to the nominal transport speed of the transport roller 34.

In order to precisely adjust the intercheck gap, the leading edge 18 of the second document 12*b* is detected by the sensor 48 upon commencement of interruption of the light beam thereto, at which time the first encoder 50 corresponding with the rotary position of the separation roller 30 is suitably position stamped by the controller. As shown in FIG. 4, position stamping of the leading edge 18 of the second check 12*b* corresponds with a constant advance length A between the optical sensor 48 and the last pinch point at the end of the driving control of the separation roller 30 for the second check prior to transferring transport control to the downstream transport roller 34. The minimum check length B is another constant value, and the difference C between the minimum check length and the advance length A is the minimum remaining length of the second check subject to control of the separation roller 30 prior to being discharged downstream therefrom.

Accordingly, active correction of the intercheck gap G may occur in some or all of the remaining length C of the second check under control of the separation roller 30. The speed of the separation roller 30 may be changed in a myriad of combinations within the available remaining check length C for actively adjusting the intercheck gap G from its initial measured value.

For example, the separation roller 30 may be temporarily halted to increase the intercheck gap as desired. The duration of the roller halt is simply the time required to increase the intercheck gap the desired amount based on the transport speed of the downstream first check 12*a*. The halt time is simply the desired gap increase divided by the linear speed of the downstream check 12*a*, with any suitable adjustment for electrical and mechanical response delays.

However, in the preferred embodiment illustrated in FIG. 4, the intercheck gap spacing between the two checks 12*a,b* is increased by simply reducing the speed of the separation roller 30 to a speed below the nominal transport speed thereof, but greater than zero. Since the remaining length C for active gap correction is relatively long, the desired gap correction may be effected over the entire length C which typically requires only slight reduction in the speed of the separation roller 30.

After the speed of the separation roller 30 is temporarily changed for effecting the desired active correction of the intercheck gap G, the speed change of the separation roller is terminated to return the separation roller to its nominal transport speed, which is preferably equal to the transport speed of the transport roller 34, prior to actively adjusting the intercheck gap of the next check being carried by the separation roller. In this way, the gap between each two successive checks being carried between the separation and transport rollers is initially measured, compared with the desired intercheck gap, and adjusted either up or down as required by correspondingly changing the speed of the separation roller 30 on the fly.

The active gap correction implemented in the embodiment illustrated in FIG. 4 simply introduces the single optical sensor 48 between the separation and transport rollers, the high precision rotary position encoders 50,52, and a suitably high speed controller 46 for effecting the corrections in the milliseconds required as each check is transported at the relatively high rate of 600 dpm in the preferred embodiment. Although rotary encoders and controllers are conventional, the high precision rotary position encoders 50,52 and cooperating controller 46 used in the FIG. 4 embodiment have increased costs associated therewith. Cost is a significant competitive factor in the production of commercial high speed check processing machines, and therefore it is desired to effect active gap correction at reduced costs.

Figure 5:
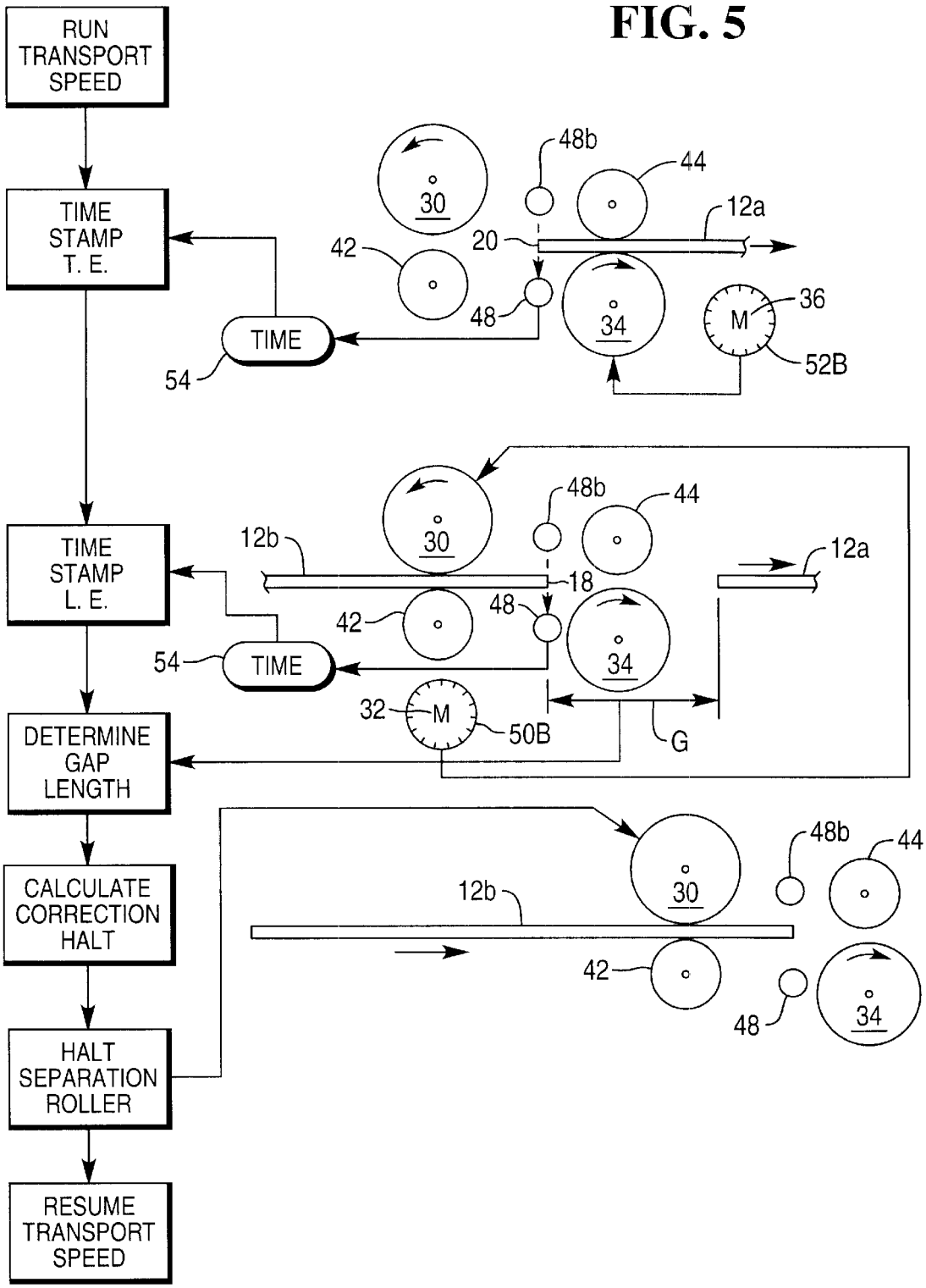
FIG. 5 is a flowchart representation of an exemplary method of operating the document feeder of FIG. 3 in accordance with a second embodiment of the present invention.

Accordingly, FIG. 5 illustrates an alternate embodiment of the present invention corresponding with the hardware illustrated in FIG. 3, but with significant savings in the cost thereof. In this embodiment, instead of using the high precision rotary position encoders 50,52 illustrated in the FIG. 4 embodiment, less costly first and second rotary speed encoders 50B,52B are used in conjunction with the corresponding stepper drive motors 32,36. Instead of having the high 4,000 count capability of the rotary position encoders 50,52 illustrated in FIG. 4, the rotary speed encoders 50B, 52B illustrated in FIG. 5 may have a substantially lower count capability, 200 counts for 50 slits per revolution in quadrature, which is sufficient for accurately measuring speed of the corresponding drive motors 32,36.

The rotary speed encoders are similarly operatively joined to the controller 46 illustrated in FIG. 3 for providing feedback thereto of the measured speeds of the separation and transport rollers. As shown schematically in FIG. 5, the controller includes a cooperating precision clock 54 and is operatively joined to the optical sensor 48.

With these elements, the controller is preferably configured for measuring the intercheck gap G between the trailing edge 20 of the first check 12*a* that passes the optical sensor 48 and the leading edge 18 of the second check 12*a* passing the sensor in turn, by the product of the corresponding difference in time or elapsed time between detection of the trailing and leading edges and the speed of the first check 12*a* driven by the transport roller. Since the transport roller 34 preferably operates at a constant rotary speed, the corresponding linear transport speed of the checks being driven thereby is also constant. By measuring the time difference between the successive trailing and leading edges of the checks, the corresponding intercheck gaps therebetween is simply the product of that time difference and the linear speed of the downstream first check 12*a*.

As shown schematically in FIG. 5, the optical sensor 48 is used for detecting the trailing edge 20 of the first check 12*a* passing the sensor under control of the transport roller 34, and the controller is used for time stamping the clock corresponding with the location of the trailing edge.

As the checks continue to be transported along the feedpath, the same optical sensor 48 is again used for detecting the leading edge 18 of the following second check 12*b* as it reaches the sensor, and the controller again time stamps the clock for determining the corresponding time of leading edge detection.

The length of the intercheck gap G may then be readily calculated by the product of the differential or elapsed time between detection of the time stamped trailing and leading edges and the speed of the first check 12*a* driven by the constant speed transport roller 34.

Since an accurate measurement of the intercheck gap G has now been determined, that gap is compared in the controller to the desired gap stored in memory and adjusted either up or down as required. As indicated above, the speed of the separation roller 30 may again be temporarily changed after time stamping of the leading edge of the second check 12*b* to actively adjust the intercheck gap as the second check 12*b* is driven by the separation roller for the remaining portion of the length thereof.

In the preferred embodiment illustrated in FIG. 5, the separation roller 30 is temporarily halted to a complete stop of zero speed for a suitable portion of the remaining length of the second check 12*b* being driven thereby to correspondingly increase the intercheck gap to a value greater than or equal to the desired minimum gap. The temporary halting of the separation roller 30 occurs for a time duration equal to the required increase in intercheck gap divided by the linear transport speed of the downstream first check 12*a*. That gap correction can be effected within a portion of the remaining length of the upstream second check 12*b* within the control of the separation roller 30, with suitable adjustments as desired for the electrical and mechanical time lags associated with temporarily halting the separation roller 30 and re-accelerating the separation roller back to its nominal transport speed.

This active gap control process is readily effected with less costly speed encoders 50B,52B, and with a correspondingly less expensive controller 46 which requires less computational capability and response time for implementing the time-based active gap correction.

A particular advantage of the active gap correction apparatus disclosed above is its ability to be operated for further maximizing the throughput rate of the document feeder while maintaining relatively small intercheck gaps substantially equal to or only slightly greater than the desired minimum intercheck gap. As indicated above, the encoder 16 illustrated in FIG. 1 typically sets the minimum acceptable intercheck gap for the entire check processing machine. That minimum gap may be about 3 inches (7.6 cm) for example while the check processor is operated at the 600 dpm high throughput rate.

Accordingly, the separation and transport rollers 30,34 illustrated in FIG. 3 may be initially operated to drive the checks 12 between the feeder and the encoder at the maximum desired throughput rate, with an initial intercheck gap initially selected to be less than the minimum acceptable gap for continuous operation of the encoder 16 without malfunction or failure thereof in accordance with its design specifications. The advance roller 26 is correspondingly operated at a slower rotational speed than the separation roller 30 to effect the less than minimum intercheck gap.

The optical sensor 48 and the rotary encoders may then be used as described above for measuring the actual intercheck gap between successive checks as they are transferred between the separation and transport rollers.

The controller 46 uses the feedback from the optical sensor and rotary encoders for temporarily reducing the speed of the separation roller 30 as described in the various embodiments disclosed above for each of the checks in sequence as they pass the optical sensor to suitably increase the intercheck gap to a value either equal to or slightly greater than the desired minimum gap for maintaining the maximum throughput rate.

In this way, the check processing machine may be configured for maximizing throughput while minimizing the intercheck gap according to that minimum gap required by any one of the modules thereof. The checks are initially transported with sub-minimum intercheck gaps and actively corrected on the fly in the feeder module to precisely achieve the desired minimum intercheck gap for effective operation of the various modules downstream therefrom.

Irrespective of the variation in lengths of the checks being processed, and irrespective of the frictional characteristics of the advance and separation rollers 26,30 initially effecting the intercheck gaps, the active gap control is effected at the beginning of the transport portion of the feedpath for ensuring maximum throughput operation of the entire check processing machine for maintaining the continuous operation thereof without premature malfunction or jamming due to sub-minimum intercheck gaps.

Although various embodiments of the document feeder have been described above for maximizing the throughput rate while minimizing the intercheck gaps, the apparatus may be otherwise operated to advantage. For example, excessively large intercheck gaps may be reduced by temporarily accelerating the separation roller to a higher speed. Acceleration correction of gap length will require a corresponding separation drive motor with sufficient torque and time response, typically at increased cost. However, decreased equipment cost is associated with reducing or temporarily halting operation of the separation roller 30 as required between successive checks for increasing the too small intercheck gaps therebetween.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured Letters Patent of the United States is the invention as defined and differentiated in the following claims in which we claim:

1. A document feeder comprising:

an input tray for receiving a stack of documents;

an advance roller adjoining said tray for driving said documents in turn along a feedpath from said tray;

a separation roller adjoining said advance roller for further driving said documents along said feedpath from said advance roller and creating corresponding interdocument gaps between leading and trailing documents in turn;

a transport roller spaced downstream from said separation roller for further driving said documents along said feedpath;

a sensor disposed between said separation and transport rollers for detecting presence of said documents therebetween;

a controller operatively joined to said advance, separation, and transport rollers for controlling speed thereof, and operatively joined to said sensor for measuring said interdocument gaps between said separation and transport rollers;

said controller being further configured for operating said separation roller at a speed greater than the speed of said advance roller to create said interdocumnent gaps, and for actively adjusting said interdocument gaps by temporarily changing speed of said separation and advance rollers simultaneously as each of said documents is transferred from said advance and separation rollers to said transport roller;

a retard roller disposed opposite to said advance roller for retarding feeding of more than one document at a time from said tray;

said controller is configured to operate said separation roller at a greater speed than said advance roller to effect a natural gap between successive documents carried from said advance roller to said separation roller;

a first rotary position encoder cooperating with said separation roller for measuring rotary position thereof, and operatively joined to said controller;

a second rotary position encoder cooperating with said transport roller for measuring rotary position thereof, and operatively joined to said controller; and said controller being configured to measure a gap between a trailing edge of a first document passing said sensor and a leading edge of a second document passing said sensor by a corresponding difference in positions of said second encoder.

2. A method of operating said feeder according to claim 1 comprising:

detecting said trailing edge of said first document passing said sensor, and position stamping said second encoder;

detecting said leading edge of said second document passing said sensor, and again position stamping said second encoder; and calculating a difference in said position stampings of said second encoder between said trading edge of said first document and leading edge of said second document for determining said gap therebetween.

3. A method according to claim 2 comprising:

detecting said leading edge of second document passing said sensor, and position stamping said first encoder; and changing speed of said separation roller temporarily after said position stamping of said first encoder to actively adjust said interdocument gap as said second document is driven by said separation roller for a portion of the length of said second document.

4. A method according to claim 3 further comprising terminating said speed change of said separation roller prior to actively adjusting interdocument gap of the next document carried by said separation roller.

5. A method according to claim 4 wherein said separation roller speed is reduced to increase spacing between said first and second documents greater than said measured gap.

6. A method according to claim 5 wherein said separation roller is temporarily halted to increase said interdocument gap.

7. A document feeder comprising:

an input tray for receiving a stack of documents;

an advance roller adjoining said tray for driving said documents in turn along a feedpath from said tray;

a separation roller adjoining said advance roller for further driving said documents along said feedpath from said advance roller and creating corresponding interdocument gaps between leading and trailing documents in turn;

a transport roller spaced downstream from said separation roller for further driving said documents along said feedpath;

a sensor disposed between said separation and transport rollers for detecting presence of said documents therebetween;

a controller operatively joined to said advance, separation, and transport rollers for controlling speed thereof, and operatively joined to said sensor for measuring said interdocument gaps between said separation and transport rollers;

said controller being further configured for operating said separation roller at a speed greater than the speed of said advance roller to create said interdocument gaps, and for actively adjusting said interdocument gaps by temporarily changing speed of said separation and advance rollers simultaneously as each of said documents is transferred from said advance and separation rollers to said transport roller;

a retard roller disposed opposite to said advance roller for retarding feeding of more than one document at a time from said tray;

said controller is configured to operate said separation roller at a greater speed than said advance roller to effect a natural gap between successive documents carried from said advance roller to said separation roller;

a first rotary speed encoder cooperating with said separation roller for measuring rotary speed thereof, and operatively joined to said controller;

a second rotary speed encoder cooperating with said transport roller for measuring rotary speed thereof, and operatively joined to said controller; and said controller further includes a clock operatively joined to said sensor, and is further configured to measure said gap between a trailing edge of a first document passing said sensor and a leading edge of a second document passing said sensor by the product of corresponding difference in time therebetween and speed of said first document driven by said transport roller.

8. A method of operating said feeder according to claim 7 comprising:

detecting said trailing edge of said first document passing said sensor, and time stamping said clock;

detecting said leading edge of said second document passing said sensor, and again time stamping said clock; and calculating length of said interdocument gap by the product of differential time between said trailing and leading edge time stamping and speed of said first document driven by said transport roller.

9. A method according to claim 8 further comprising changing speed of said separation roller temporarily after time stamping said leading edge of said second document to actively adjust said interdocument gap as said second document is driven by said separation roller for a portion of the length thereof.

10. A method according to claim 9 further comprising terminating said speed change of said separation roller prior to actively adjusting interdocument gap of the next document carried by said separation roller.

11. A method according to claim 10 wherein said separation roller speed is reduced to increase spacing between said first and second documents greater than said measured gap.

12. A method according to claim 11 wherein said separation roller is temporarily halted to increase said interdocument gap.

* * * * *